US009975365B2

(12) United States Patent
Hwa et al.

(10) Patent No.: US 9,975,365 B2
(45) Date of Patent: May 22, 2018

(54) THERMAL PRINTER AND METHOD FOR CONTROLLING THE SAME

(71) Applicant: TOSHIBA TEC KABUSHIKI KAISHA, Shinagawa-ku, Tokyo (JP)

(72) Inventors: Lee Men Hwa, Singapore (SG); Norihisa Shiraishi, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/384,438

(22) Filed: Dec. 20, 2016

(65) Prior Publication Data

US 2017/0182823 A1 Jun. 29, 2017

(30) Foreign Application Priority Data

Dec. 25, 2015 (JP) ..... 2015-255311

(51) Int. Cl.

*B41J 2/36* (2006.01)
*B41J 29/393* (2006.01)
*B41J 2/32* (2006.01)

(52) U.S. Cl.

CPC ..... *B41J 29/393* (2013.01); *B41J 2/32* (2013.01); *B41J 2/36* (2013.01); *B41J 2/362* (2013.01)

(58) Field of Classification Search

CPC ..... B41J 3/60; B41J 2/36; B41J 2/362; B41J 2/365; B41J 2/37

See application file for complete search history.

(56) References Cited

U.S. PATENT DOCUMENTS 5,353,052 A * 10/1994 Suzuki ..... B41J 2/16588 347/19
5,378,563 A * 1/1995 Ito ..... H04N 1/4078 430/30
6,045,210 A * 4/2000 Suzuki ..... H04N 1/4015 347/19
6,504,562 B2 * 1/2003 Kojima ..... B41J 2/362 347/188
7,671,878 B2 3/2010 Yamada (Continued)

FOREIGN PATENT DOCUMENTS

JP 61-229576 * 10/1986 ..... B41J 2/36
JP 63-147668 * 6/1988 ..... B41J 2/36

(Continued)

OTHER PUBLICATIONS

Computer-generated translation of JP 04-64459, published on Feb. 1992.*

*Primary Examiner* — Huan Tran
(74) *Attorney, Agent, or Firm* — Amin, Turocy & Watson LLP

(57) ABSTRACT

In accordance with an embodiment, a thermal printer comprises a first thermal head, a first sensor and a control section. The first thermal head prints a first mark on a first surface of an image receiving medium. The first sensor detects a printing density of the first mark. The control section determines whether or not the printing density of the first mark is in a predetermined range, and adjusts the printing density by the first thermal head in the predetermined range in response to determining that the printing density of the first mark is out of the predetermined range.

20 Claims, 6 Drawing Sheets

(56) References Cited

U.S. PATENT DOCUMENTS

| | | | | |
|---|---|---|---|---|
| 7,948,510 | B2 * | 5/2011 | Iwazaki | B41J 2/32<br>347/188 |
| 8,537,189 | B2 | 9/2013 | Shiraishi | |

FOREIGN PATENT DOCUMENTS

| | | | | |
|---|---|---|---|---|
| JP | 63-151470 | * | 6/1988 | B41J 2/36 |
| JP | 01-238958 | * | 9/1989 | B41J 2/36 |
| JP | 04-064459 | * | 2/1992 | B41J 2/36 |
| JP | 08-090833 | * | 4/1996 | B41J 2/36 |
| JP | 09-174912 | * | 7/1997 | B41J 2/36 |

* cited by examiner

THERMAL PRINTER AND METHOD FOR CONTROLLING THE SAME

CROSS-REFERENCE TO RELATED APPLICATIONS

This application is based upon and claims the benefit of priority from Japanese Patent Application No. 2015-255311, filed Dec. 25, 2015, the entire contents of which are incorporated herein by reference.

FIELD

Embodiments described herein relate generally to a thermal printer and a method for controlling the thermal printer.

BACKGROUND

A thermal printer prints on a paper including a heat-sensitive layer by heat generated by each of a plurality of heat generating elements which constitutes a thermal head. The printing density by the thermal printer is changed depending on a strobe signal applied to each of the plurality of the heat generating elements which constitutes the thermal head.

On the other hand, such a thermal printer supports various types of papers. Different types of papers include substances which are different from each other. Thus, characteristics of the papers are different. Furthermore, even if the types of the papers are the same, the characteristics of the papers can be different corresponding to different storage conditions (such as differences in temperature, humidity, storage period, and the like) of the papers.

DETAILED DESCRIPTION

In accordance with an embodiment, a thermal printer comprises a first thermal head, a first sensor and a control section. The first thermal head prints a first mark on a first surface of an image receiving medium. The first sensor detects a printing density of the first mark. The control section determines whether or not the printing density of the first mark is in a predetermined range, and adjusts the printing density by the first thermal head in the predetermined range in response to determining that the printing density of the first mark is out of the predetermined range.

Figure 1:
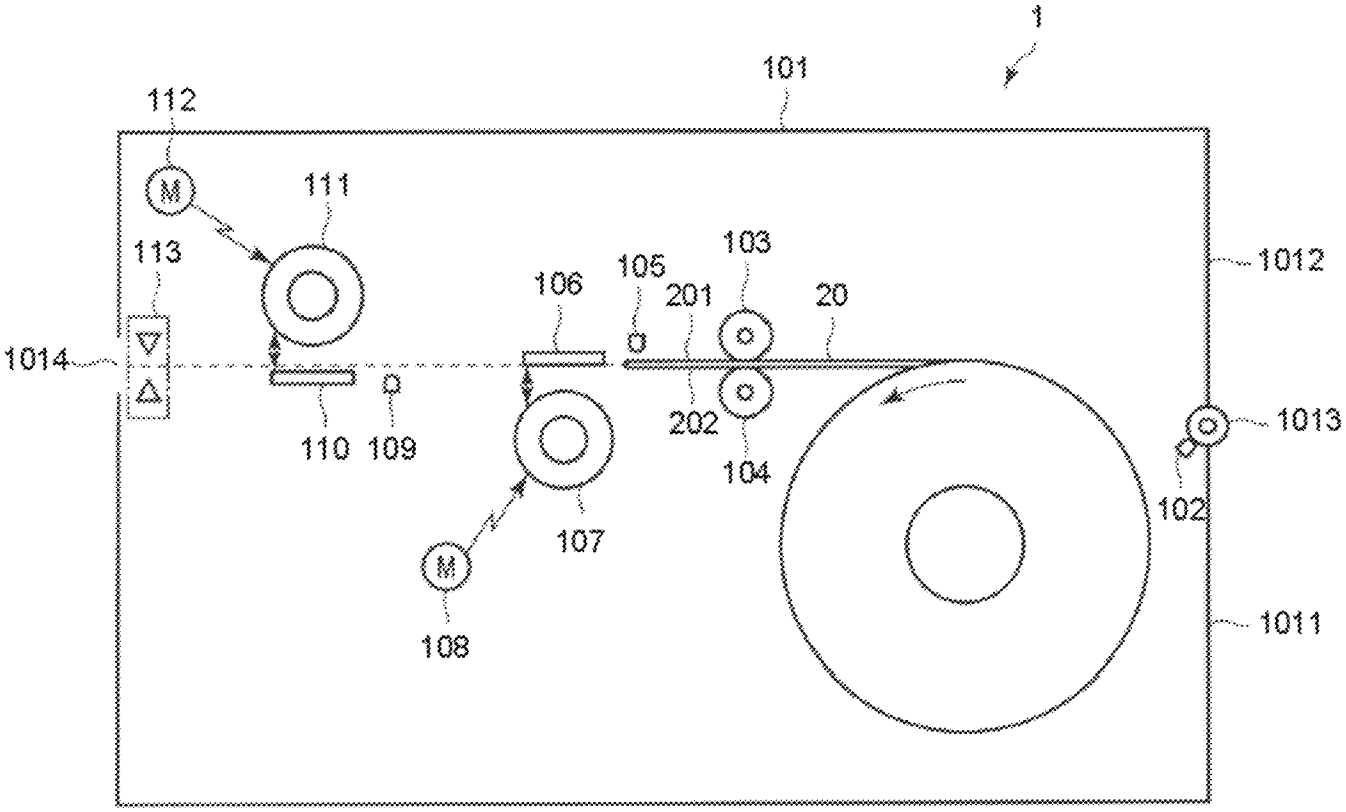
FIG. 1 is a schematic diagram of a thermal printer according to an embodiment.

Hereinafter, an embodiment is described with reference to the accompanying drawings. FIG. 1 is a schematic diagram as an example of a thermal printer 1. The thermal printer 1 is provided with a housing 101, an opening and closing sensor 102, a first conveyance roller 103, a second conveyance roller 104, a first density sensor 105, a first thermal head 106, a first platen roller 107, a first motor 108, a second density sensor 109, a second thermal head 110, a second platen roller 111, a second motor 112 and a cutter 113.

The housing 101 houses each section constituting the thermal printer 1 and a thermal paper (image receiving medium) 20. The thermal paper 20 includes a first surface 201 and a second surface 202 facing the first surface 201. The thermal paper 20 is wound into a roll-shape in a state in which the first surface 201 becomes outside. The thermal paper 20 includes heat-sensitive layers respectively at the first surface 201 side and the second surface 202 side with respect to the center of the thickness thereof. The heat-sensitive layer includes a material for developing, for example, black when heated to a temperature equal to or greater than a predetermined temperature. In the vicinity of a first end part in a width direction of the first surface 201 of the thermal paper 20, a black mark with a predetermined size is printed in advance at a predetermined interval along a length direction orthogonal to the width direction. The black mark is a sign for cutting the thermal paper 20.

The housing 101 is provided with a housing main body 1011, a cover 1012 and a hinge section 1013. The cover 1012 is rotatably connected with the housing main body 1011 via the hinge section 1013. A state in which the cover 1012 is closed with respect to the housing main body 1011 is called a closed state. A state in which the cover 1012 is opened with respect to the housing main body 1011 is called an opened state. In a case in which the cover 1012 is the opened state, a user can exchange the thermal paper 20.

Furthermore, the housing 101 is provided with a discharge port 1014. The front end of the thermal paper 20 is discharged from the inside of the housing 101 to the outside via the discharge port 1014.

The opening and closing sensor 102 detects the closed state or the opened state of the cover 1012. The opening and closing sensor 102 is, for example, a push button-type switch. When the cover 1012 is the opened state, the cover 1012 pushes the switch. The opening and closing sensor 102 detects that the switch is pushed and outputs a signal. When the cover 1012 is in the closed state, the cover 1012 does not push the switch. The opening and closing sensor 102 does not detect that the switch is pushed, and thus does not output the signal. The opening and closing sensor 102 may be a sensor such as an optical sensor.

The first conveyance roller 103 and the second conveyance roller 104 face each other. The first conveyance roller 103 comes in contact with the first surface 201 of the thermal paper 20. The second conveyance roller 104 comes in contact with the second surface 202 of the thermal paper 20. The first conveyance roller 103 and the second conveyance roller 104 convey the thermal paper 20 which is sandwiched therebetween. The first conveyance roller 103 and the second conveyance roller 104 supply the thermal paper 20 to the first thermal head 106 described later. A direction from a position at which the thermal paper 20 comes in contact with the first conveyance roller 103 and the second conveyance roller 104 towards the discharge port 1014 is called a first direction. A direction opposite to the first direction is called a second direction.

The first density sensor 105 is arranged at the discharge port 1014 side with respect to the first conveyance roller 103 and the second conveyance roller 104. The first density sensor 105 faces the first surface 201 of the thermal paper 20. For example, the first density sensor 105 faces the vicinity of the first end part in the width direction of the first surface 201 of the thermal paper 20. Thus, the detection range of the first density sensor 105 is the vicinity of the first end part in the width direction of the first surface 201 of the thermal paper 20. The first density sensor 105 detects the printing density of the mark printed on the first surface 201 of the thermal paper 20 by the first thermal head 106 described later. The first density sensor 105 is an optical sensor which includes, for example, a light-emitting element for emitting light to the first surface 201 of the thermal paper 20 and a light-receiving element for receiving reflected light from the first surface 201. The first density sensor 105 detects a light-receiving level of the light-receiving element and outputs a signal corresponding to the light-receiving level (printing density). Further, the first density sensor 105 can use a BM (Black Mark) sensor loaded on an existing duplex printer. The BM sensor is constituted by the above-mentioned optical sensor. The BM sensor is used for detecting the foregoing black mark printed on the thermal paper 20 in advance. The BM sensor can detect the black mark according to a density difference between a color (for example, white) of the first surface 201 itself and a color (black) of the black mark. The first density sensor 105 can detect not only the black mark but also the printing density of the mark printed on the first surface 201 by using the BM sensor.

The first thermal head 106 is arranged at the discharge port 1014 side with respect to the first density sensor 105. The first thermal head 106 includes a plurality of heat generating elements which comes in contact with the first surface 201 of the thermal paper 20. Each of the plurality of the heat generating elements generates heat depending on a strobe signal (control signal) to be applied. The plurality of the heat generating elements is arranged linearly along the width direction of the thermal paper 20.

The first platen roller 107 faces the first thermal head 106. The first motor 108 drives the first platen roller 107. The first platen roller 107 is close to or separated from the first thermal head 106 depending on the drive of the first motor 108. The first thermal head 106 comes in contact with the first surface 201 of the thermal paper 20 more efficiently in such a manner that the first platen roller 107 inserts the thermal paper 20 between itself and the first thermal head 106.

The second density sensor 109 is arranged at the discharge port 1014 side with respect to the first thermal head 106. Further, the second density sensor 109 faces the second surface 202 of the thermal paper 20. For example, the second density sensor 109 faces the vicinity of the center part in the width direction of the second surface 202 of the thermal paper 20. Thus, the detection range of the second density sensor 109 is the vicinity of the center part in the width direction of the second surface 202 of the thermal paper 20. The second density sensor 109 detects the printing density of the mark printed on the second surface 202 of the thermal paper 20 by the second thermal head 110 described later. The second density sensor 109 is, for example, the same optical sensor as the first density sensor 105. Further, the second density sensor 109 can also use a duplex printing paper detection sensor loaded on an existing duplex printer. The duplex printing paper detection sensor is constituted by the above-mentioned optical sensor. The duplex printing paper detection sensor is used for determining whether or not the fed thermal paper 20 is a paper for duplex printing. The duplex printing paper detection sensor detects a density of a dedicated pattern to be printed on the second surface 202 of the thermal paper 20 immediately after paper feeding by the second thermal head 110. The duplex printing paper detection sensor determines whether or not the fed thermal paper 20 is a paper for duplex printing according to whether or not the density of the dedicated pattern is equal to or greater than a predetermined density. The second density sensor 109 not only can determine whether or not the thermal paper 20 is the paper for duplex printing but also can detect the printing density of the mark printed on the second surface 202 by using the duplex printing paper detection sensor.

The second thermal head 110 is arranged at the discharge port 1014 side with respect to the second density sensor 109. The second thermal head 110 includes a plurality of heat generating elements which comes in contact with the second surface 202 of the thermal paper 20. Each of the plurality of the heat generating elements generates heat depending on a strobe signal to be applied. The plurality of the heat generating elements is arranged linearly along the width direction of the thermal paper 20.

The second platen roller 111 faces the second thermal head 110. The second motor 112 drives the second platen roller 111. The second platen roller 111 is close to or separated from the second thermal head 110 depending on the drive of the second motor 112. The second thermal head 110 comes in contact with the second surface 202 of the thermal paper 20 more efficiently in such a manner that the second platen roller 111 inserts the thermal paper 20 between itself and the second thermal head 110.

The cutter 113 is arranged at the discharge port 1014 side with respect to the second thermal head 110 and in the vicinity of the discharge port 1014. The cutter 113 cuts the thermal paper 20 and separates a printed portion of the thermal paper 20 and a non-printed portion thereof.

Figure 2:
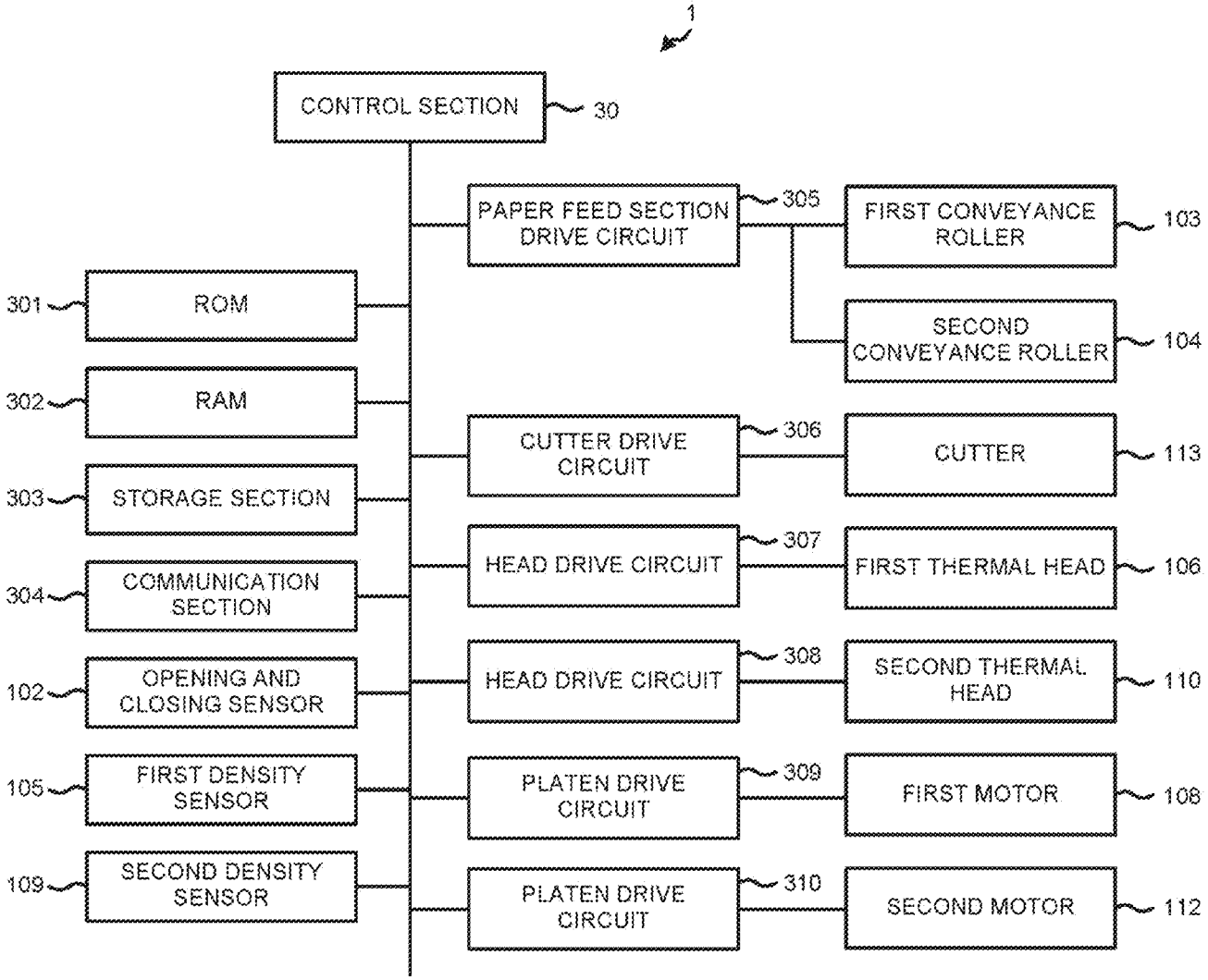
FIG. 2 is a block diagram of the thermal printer according to the present embodiment.

FIG. 2 is a block diagram of the thermal printer 1. The thermal printer 1 is provided with a control section 30, a ROM (Read Only Memory) 301, a RAM (Random. Access Memory) 302, a storage section 303, a communication section 304, a paper feed section drive circuit 305, a cutter drive circuit 306, a head drive circuit 307, a head drive circuit 308, a platen drive circuit 309, a platen drive circuit 310 and an on/off circuit 311.

The control section 30 includes a CPU (Central Processing Unit). The control section 30 acts as a computer for controlling each section of the thermal printer 1. The control section 30 determines that the cover 1012 is the opened state on the basis of the signal from the opening and closing sensor 102. The control section 30 determines the printing density by the first thermal head 106 on the basis of the signal corresponding to the printing density detected by the first density sensor 105. For example, the control section 30 carries out analog/digital conversion on the signal from the first density sensor 105. The control section 30 determines the printing density on the basis of the converted value. The control section 30 determines the printing density by the second thermal head 110 on the basis of the signal corresponding to the printing density detected by the second density sensor 109. For example, the control section 30 carries out analog/digital conversion on the signal from the first density sensor 105. The control section 30 determines the printing density on the basis of the converted value.

The ROM 301 stores various control programs necessary for operations of the thermal printer 1. The RAM 302 is a buffer memory for temporarily storing data to be generated at the time of execution of the control program. The storage section 303 is a non-volatile storage medium composed of, for example, an HDD (Hard Disk Drive). The storage section 303 stores various data and programs. The communication section 304 is, for example, a communication interface. The communication section 304 is connected with an external computer in a wired or wireless manner. The communication section 304 receives print data from the external computer.

The paper feed section drive circuit 305 drives the first conveyance roller 103 and the second conveyance roller 104. The first conveyance roller 103 and the second conveyance roller 104 convey the thermal paper 20 in the first direction or the second direction in response to the control by the paper feed section drive circuit 305.

The cutter drive circuit 306 drives the cutter 113. The cutter 113 cuts the thermal paper 20 in response to the control by the cutter drive circuit 306.

The head drive circuit 307 drives the first thermal head 106. The head drive circuit 307 applies a strobe signal corresponding to a predetermined program to each of the plurality of the heat generating elements constituting the first thermal head 106. Further, the head drive circuit 307 applies a strobe signal corresponding to print data to each of the plurality of the heat generating elements constituting the first thermal head 106.

The head drive circuit 308 drives the second thermal head 110. The head drive circuit 308 applies a strobe signal corresponding to a predetermined program to each of the plurality of the heat generating elements constituting the second thermal head 110. Further, the head drive circuit 308 applies a strobe signal corresponding to print data to each of the plurality of the heat generating elements constituting the second thermal head 110.

The platen drive circuit 309 drives the foregoing first motor 108. The platen drive circuit 310 drives the foregoing second motor 112. The on/off circuit 311 switches turning on or turning off of power supply to each section constituting the thermal printer 1 from an external power supply or internal power supply. The switching of turning on or turning off of power supply is based on input of the user.

Next, an adjustment processing (algorithm control) of the printing density in the thermal printer 1 is described. The adjustment processing is a processing which makes the printing density in the thermal printer 1 fall into a predetermined range regardless of characteristics of the thermal paper 20 inserted into the thermal printer 1.

It is assumed that a default strobe signal is applied to the first thermal head 106 and the first thermal head 106 prints on the respective thermal papers 20 before and after exchange. In this case, if the characteristics of the respective thermal papers 20 before and after exchange are different, the printing densities of the first thermal head 106 are different. Thus, there is a possibility that the printing density by the first thermal head 106 is deviated from the predetermined range. The same applies to the second thermal head 110.

The control section 30 carries out the adjustment processing before printing an image based on the print data on the thermal paper 20. The control section 30 carries out the adjustment processing on each of the first thermal head 106 and the second thermal head 110. The control section 30 may carry out the adjustment processing in the order of the first thermal head 106 and the second thermal head 110 or may carry out the adjustment processing in the reverse order.

Several examples of timing at which the control section 30 carries out the adjustment processing are described. When the control section 30 detects transition from the turning off of the power supply to the turning on, the control section 30 carries out the adjustment processing. When the control section 30 detects transition from the opened state of the cover 1012 to the closed state, the control section 30 carries out the adjustment processing.

When the control section 30 detects the insertion of the thermal paper 20 after detecting paper out, the control section 30 carries out the adjustment processing. The reason why the control section 30 carries out the adjustment processing at the foregoing timing is that there is a high possibility that the thermal paper 20 is exchanged. The control section 30 may carry out the adjustment processing at a timing other than the foregoing timing at which there is a high possibility that the thermal paper 20 is exchanged.

Figure 3:
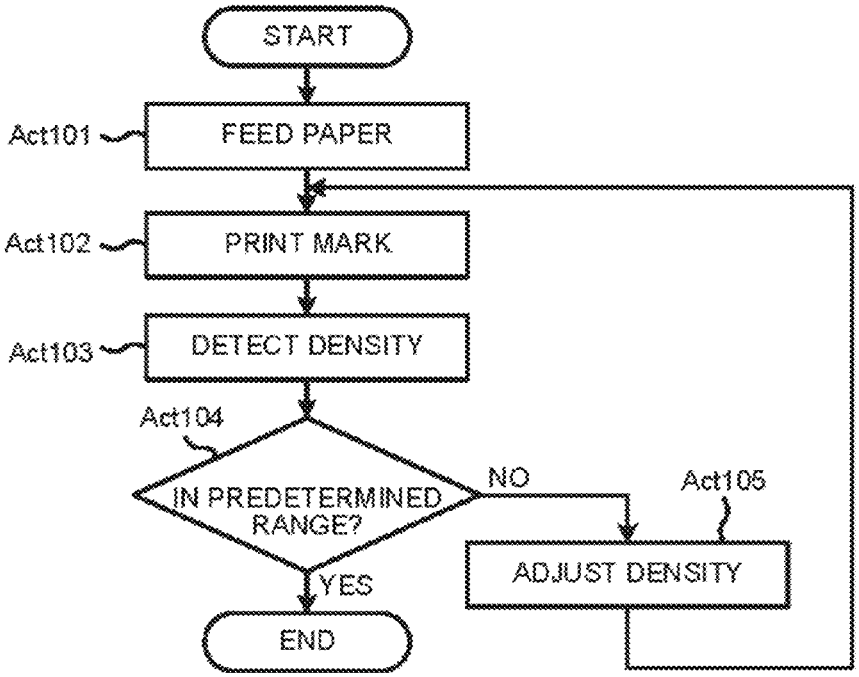
FIG. 3 is a flowchart of an adjustment processing in the thermal printer according to the present embodiment.

FIG. 3 is a flowchart for describing the adjustment processing in the thermal printer 1. Firstly, the adjustment processing of the first thermal head 106 is described.

The control section 30 controls to feed the thermal paper 20 to the first thermal head 106 (Act 101). The first conveyance roller 103 and the second conveyance roller 104 convey the thermal paper 20 along the first direction and feed the thermal paper 20 to the first thermal head 106.

The control section 30 controls to print a first mark with a predetermined size on the first surface 201 of the thermal paper 20 by the first thermal head 106 (Act 102). In this way, the first thermal head 106 prints the first mark on the first surface 201 of the thermal paper 20. For example, the first mark is a set of black dots with a predetermined size. In the processing in Act 102, the control section 30 applies the default strobe signal or a strobe signal set presently to the first thermal head 106.

The control section 30 determines the printing density of the first mark printed by the first thermal head 106 (Act 103). In the processing in Act 103, the control section 30 determines the printing density of the first mark on the basis of the signal corresponding to the printing density of the first mark detected by the first density sensor 105.

The control section 30 determines whether or not the printing density of the first mark is in a predetermined range (Act 104). The predetermined range which is a proper density range set in advance is stored in the storage section 303. The control section 30 ends the adjustment processing in response to the fact that the printing density of the first mark is in the predetermined range (Yes in Act 104).

The control section 30 adjusts the printing density by the first thermal head 106 in the predetermined range (Act 105) in response to the fact that the printing density of the first mark is out of the predetermined range (No in Act 104). In the processing in Act 105, the control section 30 adjusts a control parameter of the strobe signal according to a particular algorithm or formula. For example, the control section 30 adjusts application time of the strobe signal.

The control section 30 carries out the processing in Act 102 again after carrying out the processing in Act 105. Specifically, the control section 30 applies the strobe signal adjusted in the processing in Act 105 to the first thermal head 106. The first thermal head 106 prints the first mark on the first surface 201 of the thermal paper 20 with the adjusted density. The control section 30 repeats the processing in Act 102~105 until the printing density of the first mark falls into the predetermined range.

In the processing in Act 105, if the printing density of the first mark is lower than a lower limit value of the predetermined range, the control section 30 adjusts the strobe signal in order to thicken the printing density by the first thermal head 106. For example, the control section 30 adjusts the control parameter of the strobe signal according to the particular algorithm or formula in order to thicken the printing density by the first thermal head 106.

On the other hand, in the processing in Act 105, if the printing density of the first mark is higher than an upper limit value of the predetermined range, the control section 30 adjusts the strobe signal in order to thin the printing density by the first thermal head 106. For example, the control section 30 adjusts the control parameter of the strobe signal according to the particular algorithm or formula in order to thin the printing density by the first thermal head 106.

The control section 30 carries out the adjustment processing of the second thermal head 110 following the flowchart shown in FIG. 3, which is similar with the foregoing adjustment processing of the first thermal head 106. The control section 30 controls the second thermal head 110 instead of the first thermal head 106, and processes the signal from the second density sensor 109 instead of the first density sensor 105. The adjustment processing of the second thermal head 110 is similar with the adjustment processing of the first thermal head 106, and thus the description of the adjustment processing of the second thermal head 110 is omitted. In the processing in Act 102, a mark with a predetermined size printed on the second surface 202 of the thermal paper 20 by the second thermal head 110 is called a second mark. For example, the second mark is a set of black dots with a predetermined size.

The reason why the control section 30 carries out the adjustment processing on each of the first thermal head 106 and the second thermal head 110 is that characteristics are different for each head. The control section 30 can separately set the control parameter of the strobe signal applied to each of the first thermal head 106 and the second thermal head 110.

The control section 30 starts a normal paper feed processing of the thermal paper 20 after ending the adjustment processing on each of the first thermal head 106 and the second thermal head 110. For example, the control section 30 controls to print the image based on the print data on the first surface 201 of the thermal paper 20 by the first thermal head 106. Similarly, the control section 30 controls to print the image based on the print data on the second surface 202 of the thermal paper 20 by the second thermal head 110.

Next, an example of operations relating to the adjustment processing on the first thermal head 106 and the printing processing by the first thermal head 106 after that is described with reference to FIG. 4 and FIG. 5.

Figure 4:
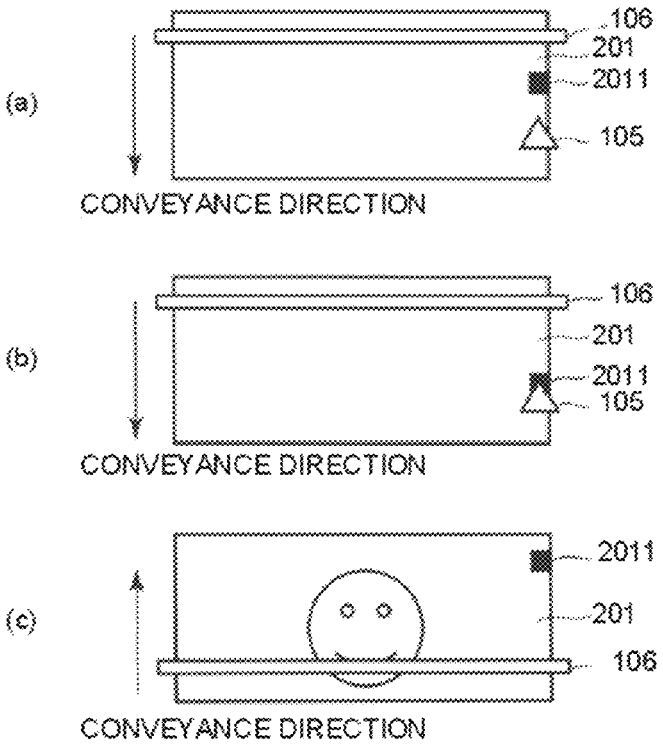
FIG. 4 is a diagram illustrating the flow of a processing relating to a first thermal head according to the present embodiment.

FIG. 4 illustrates the operations in a case in which the printing density based on the default strobe signal is in the predetermined range. In other words, the control section 30 ends the adjustment processing without carrying out the foregoing processing in Act 105.

(a) in FIG. 4 illustrates a state after the first thermal head 106 prints a first mark 2011 on the first surface 201 of the thermal paper 20 in relation to the foregoing processing in Act 102. The first thermal head 106 prints the first mark 2011 on the first surface 201 of the thermal paper 20 on the basis of the default strobe signal. The first mark 2011 is printed in the vicinity of the first end part in the width direction of the first surface 201 of the thermal paper 20. The first conveyance roller 103 and the second conveyance roller 104 convey the thermal paper 20 along the second direction until the first density sensor 105 detects the printing density of the first mark 2011.

(b) in FIG. 4 illustrates a state in which the first density sensor 105 detects the printing density of the first mark 2011 in relation to the foregoing processing in Act 103. The first conveyance roller 103 and the second conveyance roller 104 convey the thermal paper 20 along the second direction. Herein, in the foregoing processing in Act 104, the control section 30 determines that the printing density of the first mark 2011 is in the predetermined range. The control section 30 ends the adjustment processing.

(c) in FIG. 4 illustrates a state in which the printing processing is being carried out by the first thermal head 106 after the end of the adjustment processing. After the end of the adjustment processing, the first conveyance roller 103 and the second conveyance roller 104 convey the thermal paper 20 along the first direction. The first thermal head 106 prints the image based on the print data on the first surface 201 of the thermal paper 20. After the printing processing by the first thermal head 106 is ended, the control section 30 controls to discharge the printed portion of the thermal paper 20 from the discharge port 1014 to the outside of the housing 101.

Figure 5:
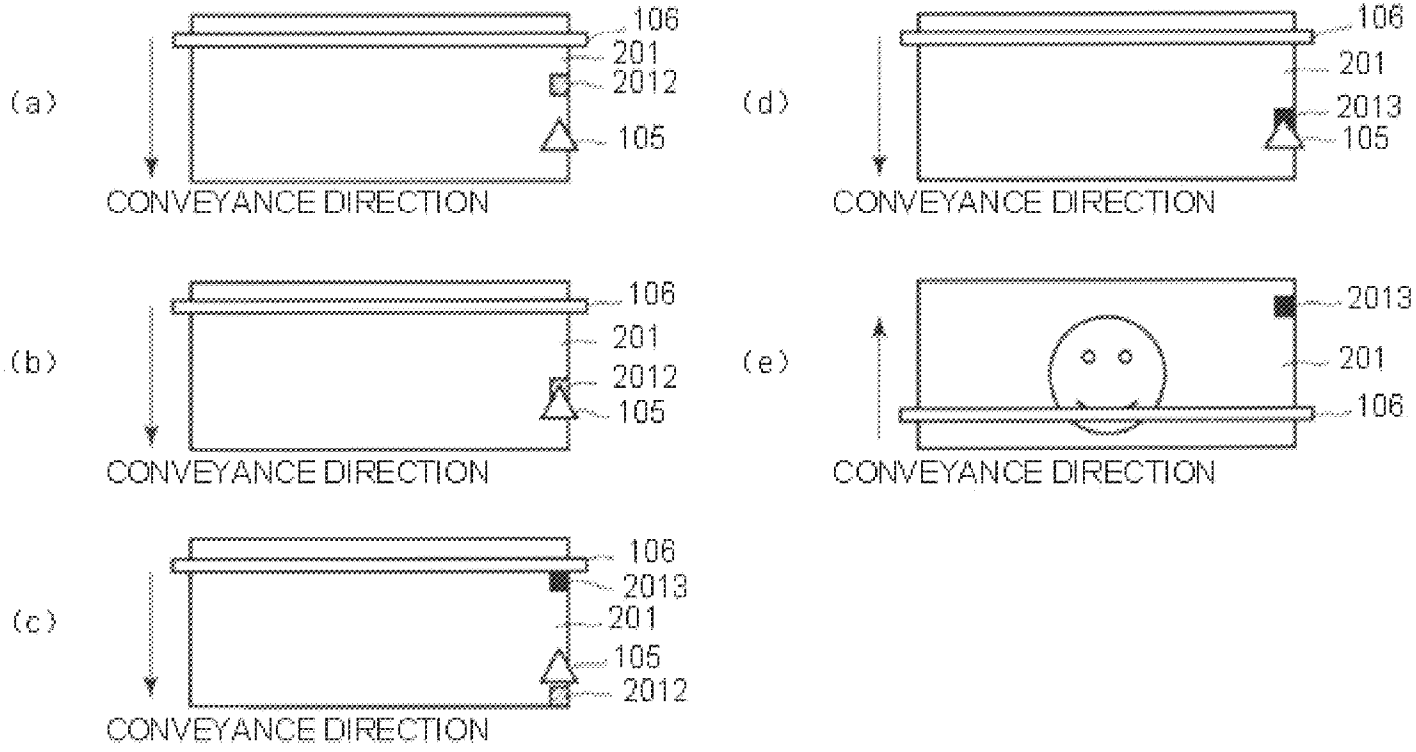
FIG. 5 is a diagram illustrating the flow of a processing relating to the first thermal head according to the present embodiment.

FIG. 5 illustrates the operations in a case in which the printing density based on the default strobe signal is out of the density range. In other words, the control section 30 ends the adjustment processing after carrying out the foregoing processing in Act 105 at least once.

(a) in FIG. 5 illustrates a state after the first thermal head 106 prints a first mark 2012 on the first surface 201 of the thermal paper 20 in relation to the foregoing processing in Act 102. The first thermal head 106 prints the first mark 2012 on the first surface 201 of the thermal paper 20 on the basis of the default strobe signal. The first mark 2012 is printed in the vicinity of the first end part in the width direction of the first surface 201 of the thermal paper 20. The first conveyance roller 103 and the second conveyance roller 104 convey the thermal paper 20 along the second direction until the first density sensor 105 detects the printing density of the first mark 2012.

(b) in FIG. 5 illustrates a state in which the first density sensor 105 detects the printing density of the first mark 2012 in relation to the foregoing processing in Act 103. The first conveyance roller 103 and the second conveyance roller 104 convey the thermal paper 20 along the second direction. Herein, in the foregoing processing in Act 104, the control section 30 determines that the printing density of the first mark 2012 is out of the predetermined range. The control section 30 adjusts the printing density by the first thermal head 106 in the foregoing processing in Act 105. The control section 30 carries out the processing in Act 102~104 again.

(c) in FIG. 5 illustrates a state after the first thermal head 106 prints a first mark 2013 on the first surface 201 of the thermal paper 20 in relation to the foregoing processing in Act 102. The first thermal head 106 prints the first mark 2013 in the vicinity of the first end part in the width direction of the first surface 201 of the thermal paper 20 on the basis of the adjusted strobe signal. The first conveyance roller 103 and the second conveyance roller 104 convey the thermal paper 20 along the second direction until the first density sensor 105 detects the printing density of the first mark 2013.

(d) in FIG. 5 illustrates a state in which the first density sensor 105 detects the printing density of the first mark 2013 in relation to the foregoing processing in Act 103. The first conveyance roller 103 and the second conveyance roller 104 convey the thermal paper 20 along the second direction. Herein, in the foregoing processing in Act 104, the control section 30 determines that the printing density of the first mark 2013 is in the predetermined range. The control section 30 ends the adjustment processing.

(e) in FIG. 5 illustrates a state in which the printing processing is being carried out by the first thermal head 106 after the end of the adjustment processing. After the end of the adjustment processing, the first conveyance roller 103 and the second conveyance roller 104 convey the thermal paper 20 along the first direction. The first thermal head 106 prints the image based on the print data on the first surface 201 of the thermal paper 20. After the printing processing by the first thermal head 106 is ended, the control section 30 controls to discharge the printed portion of the thermal paper 20 from the discharge port 1014 to the outside of the housing 101.

FIG. 5 illustrates an example in which the control section 30 carries out the processing in Act 105 once; however, the present invention is not limited to this. There is also a case in which the control section 30 repeats the processing in Act 105 twice or more.

Next, an example of operations relating to the adjustment processing on the second thermal head 110 and the printing processing by the second thermal head 110 after that is described with reference to FIG. 6 and FIG. 7.

Figure 6:
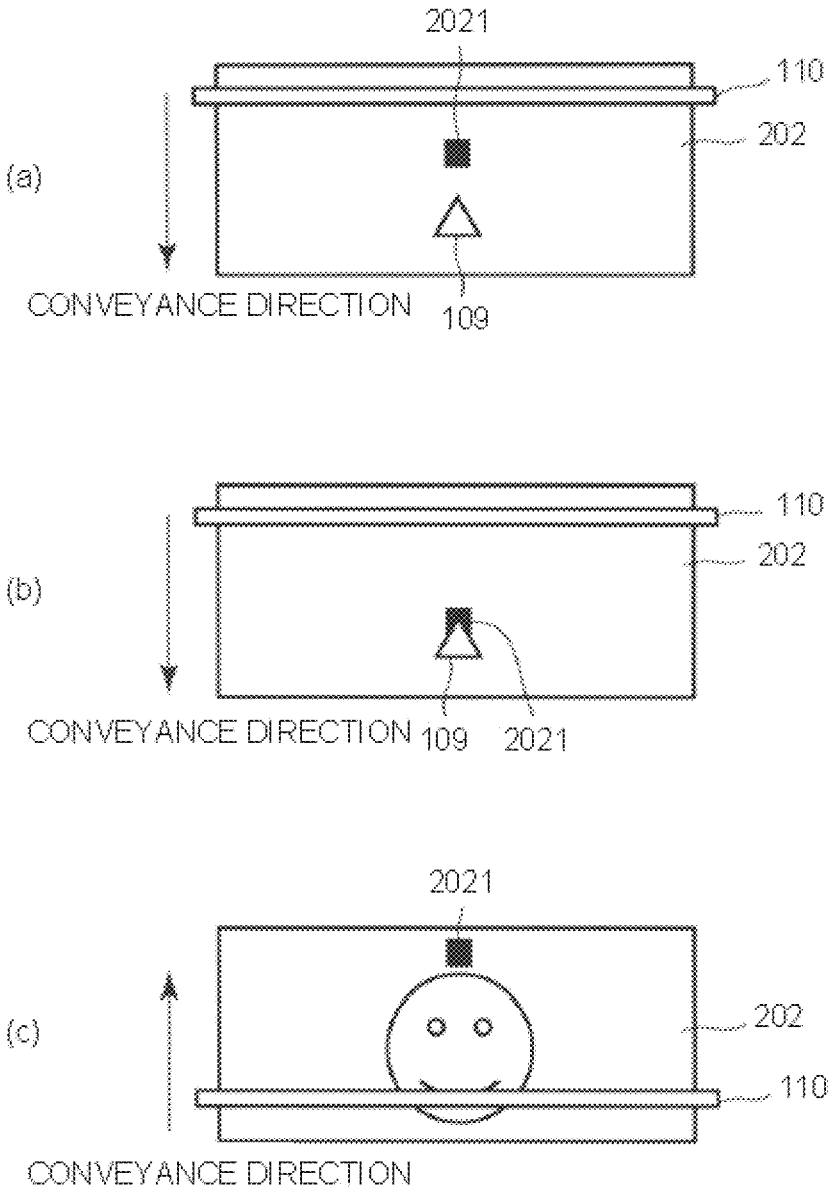
FIG. 6 is a diagram illustrating the flow of a processing relating to a second thermal head according to the present embodiment.

FIG. 6 illustrates the operations in a case in which the printing density based on the default strobe signal is in the predetermined range. In other words, the control section 30 ends the adjustment processing without carrying out the foregoing processing in Act 105.

(a) in FIG. 6 illustrates a state after the second thermal head 110 prints a second mark 2021 on the second surface 202 of the thermal paper 20 in relation to the foregoing processing in Act 102. The second thermal head 110 prints the second mark 2021 on the second surface 202 of the thermal paper 20 on the basis of the default strobe signal. The second mark 2021 is printed in the vicinity of the center part in the width direction of the second surface 202 of the thermal paper 20. The first conveyance roller 103 and the second conveyance roller 104 convey the thermal paper 20 along the second direction until the second density sensor 109 detects the printing density of the second mark 2021.

(b) in FIG. 6 illustrates a state in which the second density sensor 109 detects the printing density of the second mark 2021 in relation to the foregoing processing in Act 103. The first conveyance roller 103 and the second conveyance roller 104 convey the thermal paper 20 along the second direction. Herein, in the foregoing processing in Act 104, the control section 30 determines that the printing density of the second mark 2021 is in the predetermined range. The control section 30 ends the adjustment processing.

(c) in FIG. 6 illustrates a state in which the printing processing is being carried out by the second thermal head 110 after the end of the adjustment processing. After the end of the adjustment processing, the first conveyance roller 103 and the second conveyance roller 104 convey the thermal paper 20 along the first direction. The second thermal head 110 prints the image based on the print data on the second surface 202 of the thermal paper 20. After the printing processing by the second thermal head 110 is ended, the control section 30 controls to discharge the printed portion of the thermal paper 20 from the discharge port 1014 to the outside of the housing 101.

Figure 7:
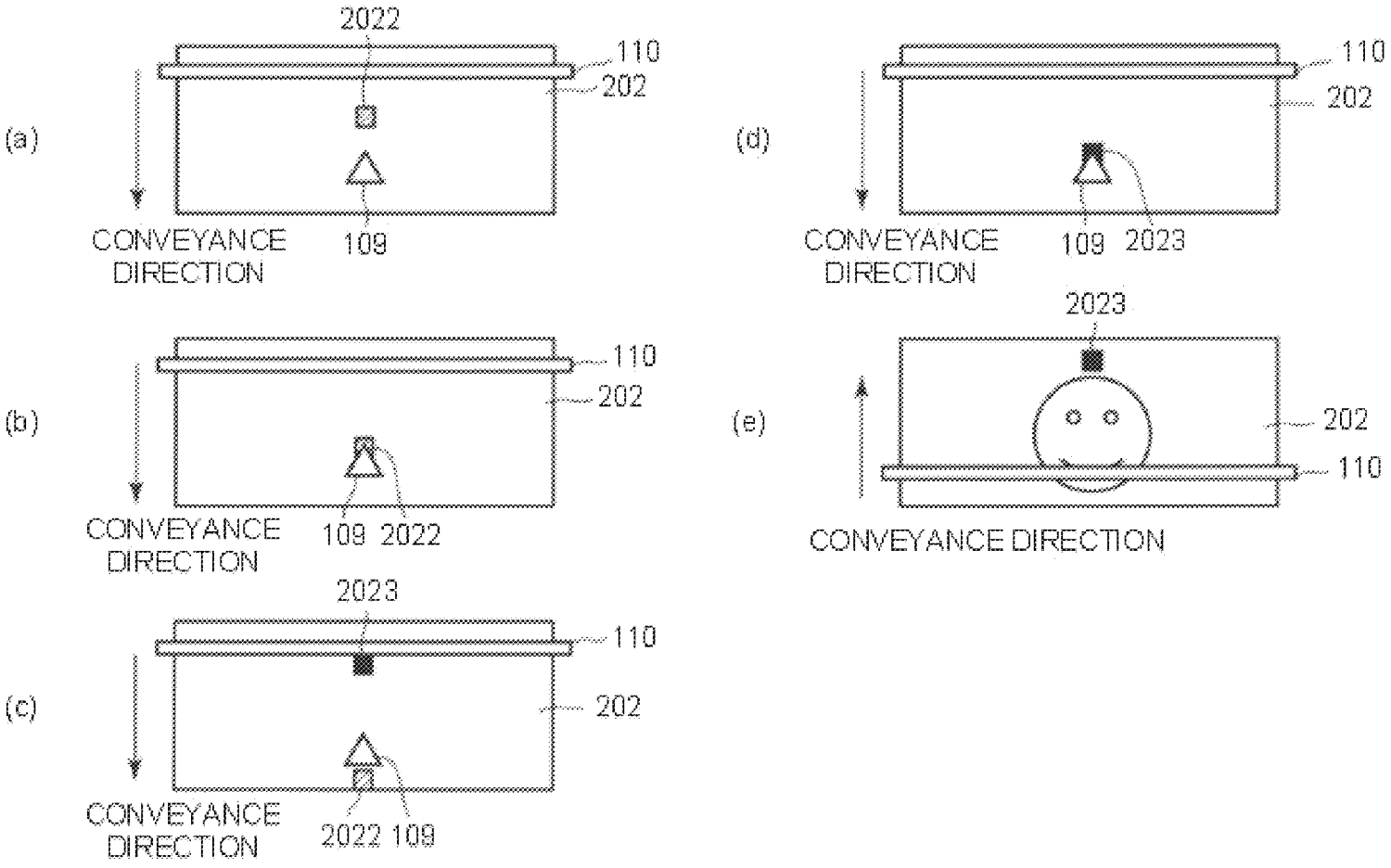
FIG. 7 is a diagram illustrating the flow of a processing relating to the second thermal head according to the present embodiment.

FIG. 7 illustrates the operations in a case in which the printing density based on the default strobe signal is out of the density range. In other words, the control section 30 ends the adjustment processing after carrying out the foregoing processing in Act 105 at least once.

(a) in FIG. 7 illustrates a state after the second thermal head 110 prints a second mark 2022 on the second surface 202 of the thermal paper 20 in relation to the foregoing processing in Act 102. The second thermal head 110 prints the second mark 2022 on the second surface 202 of the thermal paper 20 on the basis of the default strobe signal. The second mark 2022 is printed in the vicinity of the center part in the width direction of the second surface 202 of the thermal paper 20. The first conveyance roller 103 and the second conveyance roller 104 convey the thermal paper 20 along the second direction until the second density sensor 109 detects the printing density of the second mark 2022.

(b) in FIG. 7 illustrates a state in which the second density sensor 109 detects the printing density of the second mark 2022 in relation to the foregoing processing in Act 103. The first conveyance roller 103 and the second conveyance roller 104 convey the thermal paper 20 along the second direction. Herein, in the foregoing processing in Act 104, the control section 30 determines that the printing density of the second mark 2022 is out of the predetermined range. The control section 30 adjusts the printing density by the second thermal head 110 in the foregoing processing in Act 105. The control section 30 carries out the processing in Act 102~104 again.

(c) in FIG. 7 illustrates a state after the second thermal head 110 prints a second mark 2023 on the second surface 202 of the thermal paper 20 in relation to the foregoing processing in Act 102. The second thermal head 110 prints the second mark 2023 in the vicinity of the center part in the width direction of the second surface 202 of the thermal paper 20 on the basis of the adjusted strobe signal. The first conveyance roller 103 and the second conveyance roller 104 convey the thermal paper 20 along the second direction until the second density sensor 109 detects the printing density of the second mark 2023.

(d) in FIG. 7 illustrates a state in which the second density sensor 109 detects the printing density of the second mark 2023 in relation to the foregoing processing in Act 103. The first conveyance roller 103 and the second conveyance roller 104 convey the thermal paper 20 along the second direction. Herein, in the foregoing processing in Act 104, the control section 30 determines that the printing density of the second mark 2023 is in the predetermined range. The control section 30 ends the adjustment processing.

(e) in FIG. 7 illustrates a state in which the printing processing is being carried out by the second thermal head 110 after the end of the adjustment processing. After the end of the adjustment processing, the first conveyance roller 103 and the second conveyance roller 104 convey the thermal paper 20 along the first direction. The second thermal head 110 prints the image based on the print data on the second surface 202 of the thermal paper 20. After the printing processing by the second thermal head 110 is ended, the control section 30 controls to discharge the printed portion of the thermal paper 20 from the discharge port 1014 to the outside of the housing 101.

FIG. 7 illustrates an example in which the control section 30 carries out the processing in Act 105 once; however, the present invention is not limited to this. There is also a case in which the control section 30 repeats the processing in Act 105 twice or more.

Next, a relationship between a position of the first mark printed on the first surface 201 of the thermal paper 20 and a position of the second mark printed on the second surface 202 of the thermal paper 20 is described. The position in the width direction at which the first mark is printed on the first surface 201 of the thermal paper 20 does not face the position in the width direction at which the second mark is printed on the second surface 202. For example, the position in the width direction at which the first mark is printed on the first surface 201 of the thermal paper 20 is the vicinity of the first end part. The position in the width direction at which the second mark is printed on the second surface 202 is the vicinity of the center part. In other words, an area along the length direction of the thermal paper 20 including the first mark printed on the first surface 201 of the thermal paper 20 does not face an area along the length direction including the second mark printed on the second surface 202.

The relationship of the positions of the first mark and the second mark as stated above contributes to correct detection by the first density sensor 105 and the second density sensor 109 as described hereinafter. A case in which the adjustment processing is carried out in the order of the first thermal head 106 and the second thermal head 110 is assumed. The second mark is printed at a position which faces the first mark on the second surface 202. In this case, the second density sensor 109 cannot correctly detect the printing density of the second mark due to offset and the like of the first mark. According to the relationship of the positions of the first mark and the second mark as stated above, the second density sensor 109 can correctly detect the printing density of the second mark. The same applies to a case in which the adjustment processing is carried out in the order of the second thermal head 110 and the first thermal head 106. The first density sensor 105 can correctly detect the printing density of the first mark.

According to the present embodiment, the thermal printer 1 can properly adjust the printing density by the first thermal head 106 according to the characteristics of the thermal paper 20. Similarly, the thermal printer 1 can properly adjust the printing density by the second thermal head 110 according to the characteristics of the thermal paper 20. Thus, the thermal printer 1 can reduce variation of the printing density. In this way, the user can obtain a printed matter with the printing density in the predetermined range from the thermal printer 1 without adjusting the setting of the printing density on his/her own.

Furthermore, the thermal printer 1 can use the existing BM sensor as the first density sensor 105 and can use the existing duplex printing paper detection sensor as the second density sensor 109 as stated above. Thus, the thermal printer 1 can obtain the foregoing functions and effects without adding special hardware configuration to the existing duplex printer.

Further, the present embodiment describes the existing duplex printer as an example; however, the present invention is not limited to this. The thermal printer 1 may be a simplex printer which omits a group of the second density sensor 109, the second thermal head 110 and the second platen roller 111. In this case, the first density sensor 105 can use the BM sensor loaded on the existing simplex printer.

Hereinafter, several modifications of the present embodiment are described.

In the first modification, the first density sensor 105 may be arranged at the discharge port 1014 side with respect to the first thermal head 106. In this case, the control section 30 may only convey the thermal paper 20 in the first direction in the foregoing adjustment processing. Similarly, the second density sensor 109 may be arranged at the discharge port 1014 side with respect to the second thermal head 110. In this case, the control section 30 may only convey the thermal paper 20 in the first direction in the foregoing adjustment processing. As it is not necessary that the control section 30 conveys the thermal paper 20 in the second direction, time needed in the adjustment processing becomes short.

In the second modification, the thermal printer 1 may not include a group of the first density sensor 105, the first thermal head 106 and the first platen roller 107. In this case, the thermal printer 1 prints only on the second surface 202 of the thermal paper 20 with the second thermal head 110. Further, the thermal paper 20 may be a paper which is printable only on the second surface 202 side. Similarly, the thermal printer 1 may not include the group of the second density sensor 109, the second thermal head 110 and the second platen roller 111. In this case, the thermal printer 1 prints only on the first surface 201 of the thermal paper 20 with the first thermal head 106. Further, the thermal paper 20 may be a paper which is printable only on the first surface 201 side.

In the third modification, the group of the first density sensor 105, the first thermal head 106 and the first platen roller 107 may be arranged at the discharge port 1014 side with respect to the group of the second density sensor 109, the second thermal head 110 and the second platen roller 111.

Furthermore, the present embodiment may be realized by a method for controlling the thermal printer to be executed by the control section 30 (computer).

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal printer, comprising:

a first thermal head configured to print a first mark on a first surface of an image receiving medium;

a first sensor configured to detect a printing density of the first mark; and a control section configured to determine whether or not the printing density of the first mark is in a predetermined density range, and adjust the printing density by the first thermal head within the predetermined range in response to determining that the printing density of the first mark is outside of the predetermined range, wherein the print density is adjusted at different times based on a detection that thermal paper is being exchanged.

2. The thermal printer according to claim 1, wherein the control section adjusts a control signal for the first thermal head in order to thicken the printing density by the first thermal head in a case in which the printing density of the first mark is lower than an lower limit value of the predetermined density range, and adjusts the control signal in order to thin the printing density by the first thermal head in a case in which the printing density of the first mark is higher than an upper limit value of the predetermined density range.

3. The thermal printer according to claim 1, further comprising:

a second thermal head configured to print a second mark on a second surface of the image receiving medium; and a second sensor configured to detect a printing density of the second mark, wherein the control section further configured to determine whether or not the printing density of the second mark is within the predetermined density range, and adjust the printing density by the second thermal head within the predetermined density range in response to determining that the printing density of the second mark is outside of the predetermined density range.

4. The thermal printer according to claim 2, further comprising:

a second thermal head configured to print a second mark on a second surface of the image receiving medium; and a second sensor configured to detect a printing density of the second mark, wherein the control section further configured to determine whether or not the printing density of the second mark is in the predetermined density range, and adjust the printing density by the second thermal head within the predetermined density range in response to determining that the printing density of the second mark is outside of the predetermined density range.

5. The thermal printer according to claim 3, wherein a position in a width direction at which the first mark is printed on the first surface of the image receiving medium does not face a position in the width direction at which the second mark is printed on the second surface.

6. The thermal printer according to claim 1, wherein the first thermal head is configured to print a set of black dots with a predetermined size on the first surface of the image receiving medium.

7. The thermal printer according to claim 1, wherein the first sensor comprises an optical sensor.

8. The thermal printer according to claim 1, wherein the first sensor detects the printing density using a strobe signal.

9. The thermal printer according to claim 1, wherein the control section comprises a central processing unit.

10. A method for thermal printing, comprising:

printing on a first surface of a paper with a thermal head;

detecting a printing density on the first surface of a paper; and determining whether or not the detected printing density is within a predetermined density range, and adjusting the printing density by the thermal head within the predetermined density range in response to determining that the detected printing density is outside of the predetermined density range, wherein the print density is adjusted at different times based on a detection that thermal paper is being exchanged.

11. The method according to claim 10, wherein adjusting the printing density comprises adjusting a control signal for the thermal head in order to thicken the printing density in a case in which the printing density of the first mark is lower than an lower limit value of the predetermined density range, or adjusting a control signal in order to thin the printing density by the thermal head in a case in which the printing density of the first mark is higher than an upper limit value of the predetermined density range.

12. The method according to claim 10, further comprising:

printing a second mark on a second surface of the image receiving medium with a second thermal head;

detect a printing density of the second mark; and determining whether or not the printing density of the second mark is within the predetermined density range, and adjusting the printing density by the second thermal head within the predetermined density range in response to determining that the printing density of the second mark is outside of the predetermined range.

13. The method according to claim 11, further comprising:

printing a second mark on a second surface of the image receiving medium with a second thermal head;

detect a printing density of the second mark; and determining whether or not the printing density of the second mark is within the predetermined density range, and adjusting the printing density by the second thermal head within the predetermined density range in response to determining that the printing density of the second mark is outside of the predetermined density range.

14. The method according to claim 12, wherein a position in a width direction at which the first mark is printed on the first surface of the image receiving medium does not face a position in the width direction at which the second mark is printed on the second surface.

15. The method according to claim 10, wherein printing comprises printing a set of black dots with a predetermined size on the first surface of the image receiving medium.

16. The method according to claim 10, wherein detecting the printing density comprises using an optical sensor.

17. The method according to claim 10, wherein detecting the printing density comprises using a strobe signal.

18. A thermal printer, comprising:

a first thermal head configured to print a first mark on a first surface of an image receiving medium;

a first sensor configured to detect a printing density of the first mark; and a control section configured to determine whether or not the printing density of the first mark is in a predetermined density range, adjust the printing density according to characteristics of the image receiving medium, and adjust the printing density by the first thermal head within the predetermined density range in response to determining that the printing density of the first mark is outside of the predetermined density range.

19. The thermal printer according to claim 18, wherein the control section adjusts a control signal for the first thermal head in order to thicken the printing density by the first thermal head in a case in which the printing density of the first mark is lower than an lower limit value of the predetermined density range, and adjusts the control signal in order to thin the printing density by the first thermal head in a case in which the printing density of the first mark is higher than an upper limit value of the predetermined density range.

20. The thermal printer according to claim 18, further comprising:

a second thermal head configured to print a second mark on a second surface of the image receiving medium; and a second sensor configured to detect a printing density of the second mark, wherein the control section further configured to determine whether or not the printing density of the second mark is within the predetermined density range, and adjust the printing density by the second thermal head within the predetermined density range in response to determining that the printing density of the second mark is outside of the predetermined density range.

* * * * *